US005235955A

United States Patent [19]

Osaki

[11] Patent Number: 5,235,955

[45] Date of Patent: Aug. 17, 1993

[54] FUEL EVAPORATIVE EMISSION CONTROL SYSTEM

[75] Inventor: Hiroshi Osaki, Ibaraki, Japan

[73] Assignee: Kyosan Denki Kabushiki Kaisha, Tokyo, Japan

[21] Appl. No.: 900,066

[22] Filed: Jun. 16, 1992

[51] Int. Cl.[5] ..... F02M 33/02

[52] U.S. Cl. ..... 123/520; 123/516

[58] Field of Search ..... 123/516, 519, 518, 520, 123/521

[56] References Cited

U.S. PATENT DOCUMENTS

| | | | |
|---|---|---|---|
| 4,343,281 | 8/1982 | Uozumi | 123/520 |
| 4,702,216 | 10/1987 | Haruta | 123/520 |
| 4,703,737 | 11/1987 | Cook | 123/520 |
| 4,790,283 | 12/1988 | Uranishi | 123/520 |
| 4,815,436 | 3/1989 | Sasaki | 123/520 |
| 4,872,439 | 10/1989 | Sonoda | 123/519 |
| 4,887,578 | 12/1989 | Woodcock | 123/519 |
| 4,961,412 | 10/1990 | Furuyama | 123/520 |
| 5,056,494 | 10/1991 | Kayanuma | 123/519 |
| 5,067,468 | 11/1991 | Otowa | 123/520 |

*Primary Examiner*—Carl S. Miller

*Attorney, Agent, or Firm*—Flynn, Thiel, Boutell & Tanis

[57] ABSTRACT

A fuel evaporative emission control system prevents fuel evaporative emission from discharging the atmosphere from the port of a filler cap in a fuel tank when the filler cap is opened during supply of fuel in the fuel tank and prevents the fuel evaporative emission from entering into a canister. The control system comprises a fuel evaporative emission backflow valve disposed between the canister and the fuel tank, the fuel evaporative emission backflow valve being closable to communicate with the canister and the fuel tank, the fuel evaporative emission backflow valve coupled to an intake manifold and having a valve which permits communication from the fuel tank to the canister, a solenoid valve disposed between the intake manifold and the fuel evaporative emission backflow valve, the solenoid valve including a first point communicating with the fuel evaporative emission backflow valve, a second port communicating with the intake manifold and a third port communicating with the atmosphere. A CPU coupled to the filler cap of the fuel tank detects the opening of the filler cap to thereby issue instruction signals to selectively control the opening and closing of the first to third ports of the solenoid valve.

5 Claims, 7 Drawing Sheets

FUEL EVAPORATIVE EMISSION CONTROL SYSTEM

BACKGROUND OF THE INVENTION

1. Field of the Invention

The present invention relates to a fuel evaporative emission control system to be used in an internal combustion engine.

2. Prior Art

A conventional fuel evaporative emission control system is illustrated in FIGS. 6 and 7.

In FIG. 6, the system comprises a fuel tank 100, a canister 200, a fuel evaporative emission control valve 300 which is provided in the pipe for coupling the fuel tank 100 to the canister 200. The fuel evaporative emission control valve 300 prevents the fuel evaporative emission in the fuel tank 100 from discharging to the atmosphere.

That is, the fuel evaporative emission control valve 300 is opened or closed when it detects the intensity of the pressure in the fuel tank 100. When the fuel evaporative emission control valve 300 is opened, the fuel evaporative emission is supplied from the fuel tank 100 to the canister 200 through the fuel evaporative emission control valve 300.

FIG. 7 shows an arrangement of a typical fuel evaporative emission control valve which comprises a cup-shaped casing 22 having a canister communication port 21 and a collar 24 having a fuel tank communication port 23 in which the latter is retained by the former to form an integral casing. A valve 25 which permits the communication from the fuel tank side to the canister side and is brought into contact with a valve seat surface by a spring 26. A shell-type check valve 27 is disposed at the portion adjacent to the center of the valve 25 and permits the communication from the canister side to the fuel tank side when it is opened.

An operation of this fuel evaporative emission control valve will be described hereinafter. When the pressure inside the fuel tank 100 rises at a reference value by the generation of the fuel evaporative emission in the fuel tank 100, the pressure of the fuel evaporative emission exceeds the resiliency of the spring 26 to thereby open the valve 25. As a result, the fuel evaporative emission in the fuel tank 100 is supplied to the canister 200 so that the pressure in the fuel tank 100 is lowered.

When the pressure in the fuel tank 100 is lowered due to the fuel consumption or due to a cold weather, or the like, the shell-type check valve 27 is opened so that the atmospheric air is introduced from the canister 200 to the fuel tank 100, which prevents the fuel tank 100 from deforming.

However, the conventional fuel evaporative emission control system has the following drawback. That is, since the valve 25 is not opened until the pressure in the fuel tank 100 reaches the reference value, the fuel evaporative emission which remains in the fuel tank 100 is discharged into the atmosphere when a filler cap is opened at the time of fuel supply in case the pressure in the fuel tank 100 does not reach the reference value.

To solve the aforementioned drawback, if resiliency of the spring 26 is weakened, the valve 25 is opened by fluid pressure of the fuel, whereby the fluid fuel tends to introduce into the canister 200.

SUMMARY OF THE INVENTION

It is an object of the present invention to provide a fuel evaporative emission control system capable of solving the aforementioned drawback.

To achieve the above object, the fuel evaporative emission control system comprises a fuel evaporative emission backflow valve, which is provided in a pipe for connecting a fuel tank and a canister, the fuel evaporative emission backflow valve having a port, which is openable by a negative pressure in an intake manifold for permitting the communication from the fuel tank to the canister.

PREFERRED EMBODIMENT OF THE INVENTION

Figure 1:
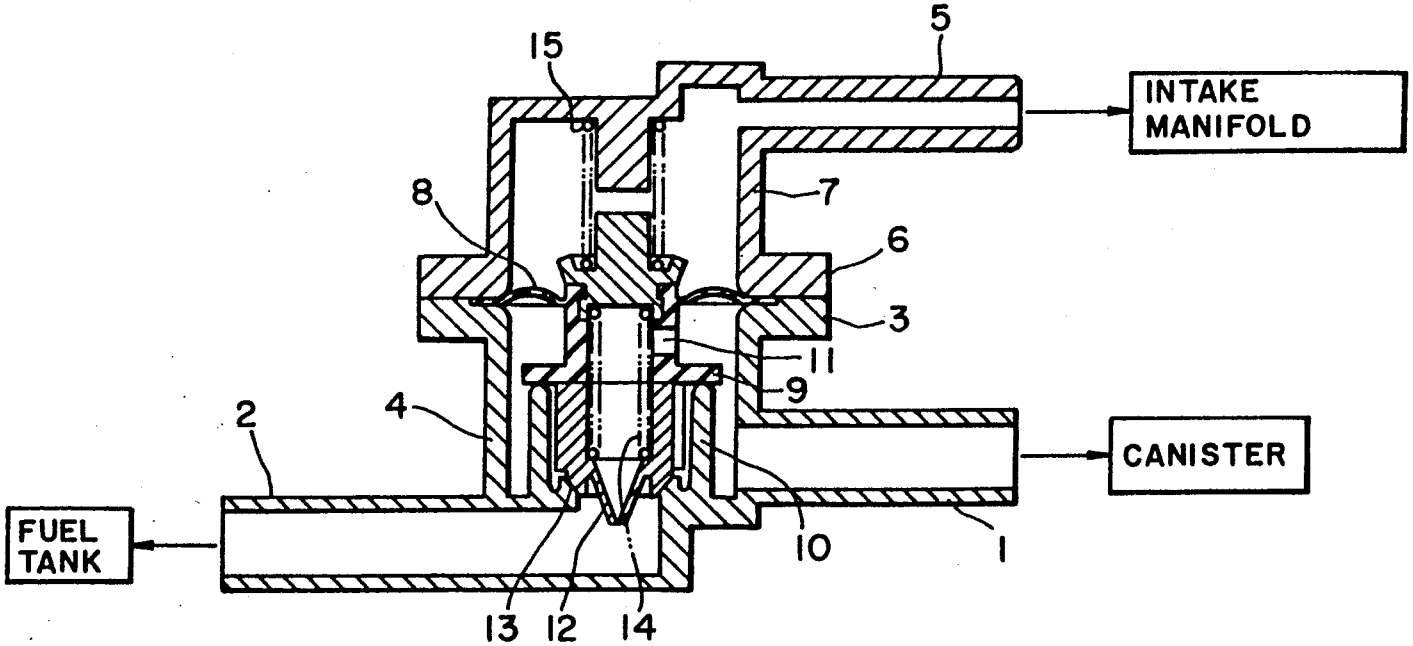
FIG. 1 is a view of assistance in explaining a fuel evaporative emission backflow valve employed in a fuel evaporative emission control system according to the present invention.

FIG. 1 shows a fuel evaporative emission backflow valve. Elements which are the same as those in the conventional control system and first to fourth embodiments of the present invention are denoted at the same numerals and the explanation thereof is omitted.

The fuel evaporative emission backflow valve comprises a first cylindrical casing 4 composed of a first port 1 communicating with a canister 200, and a second port 2 communicating with fuel tank 100 and a first collar 3, and a second cylindrical casing 7 having a third port 5 communicating with an intake manifold and a second collar 6, and a diaphragm 8 clamped by the first and second collars 3 and 6 for partitioning the first and second casings 4 and 7. The diaphragm 8 is cylindrical at the central portion thereof and extends in the direction of the first casing 4 and the tip end thereof is brought into contact with a valve seat 10 which projects from the bottom of the first casing 4. The cylindrical portion of the diaphragm 8 has a hole 11 at the part thereof. The cylindrical portion of the valve seat 10 has a slit valve 12 at the inside thereof which permits the communication from the canister to the fuel tank side and has a valve 13 at the outside thereof which permits the communication from the fuel tank side to the canister side. The valve 13 is pressed toward the valve seat portion by springs 14 and 15 at a projecting tip end 9 of the diaphragm 8. At this time, the force to press the valve 13 is set as follows. That is, pressing force of the spring 15 is strong but that of the spring 14 is weak.

First Embodiment (FIG. 2):

A fuel evaporative emission control system according to the first embodiment will be described with reference to FIG. 2.

Figure 2:
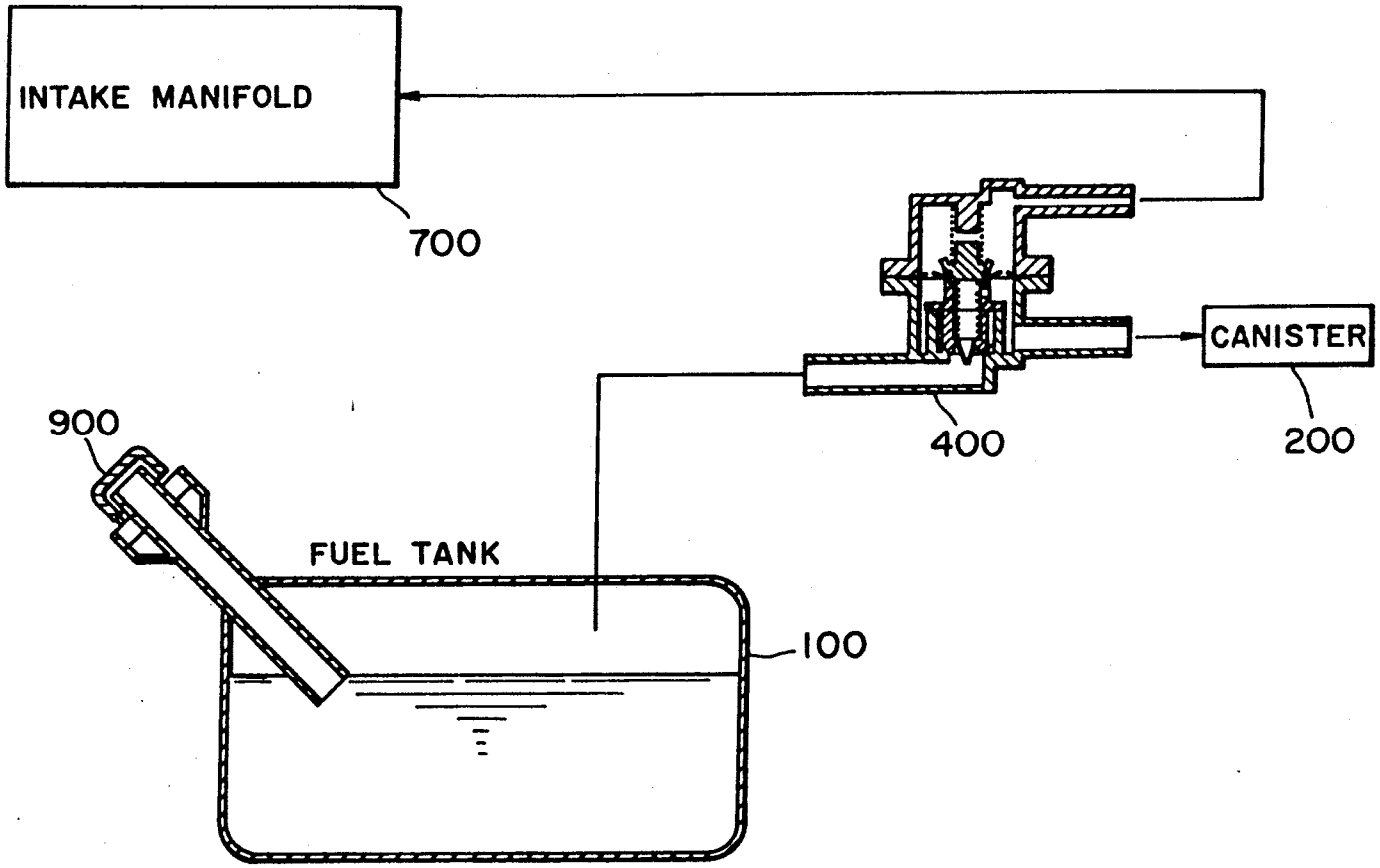
FIG. 2 is a view of assistance in explaining the fuel evaporative emission control system according to a first embodiment of the present invention.

In FIG. 2, the control system comprises the fuel tank 100, a fuel evaporative emission backflow valve 400 coupled to the fuel tank 100, the canister 200 coupled to the fuel evaporative emission backflow valve 400 and an intake manifold 700 coupled to the fuel evaporative emission backflow valve 400.

When an engine runs, the intake manifold 700 is negatively pressurized to thereby pull out the diaphragm 8 against resiliency of the strong spring 15 while the valve 13 is pressed by the weak spring 14. Accordingly, even if a small amount of fuel evaporative emission is generated in the fuel tank 100 and the pressure in the fuel tank 100 increases slightly, the valve 13 opens to thereby supply the fuel evaporative emission to the canister 200. As a result, a large amount of the fuel evaporative emission does not remain in the fuel tank 100 while the engine runs. Accordingly, even if a filler cap is opened during supply of fuel into the fuel tank 100 (hereinafter referred to as during fuel supply), it is possible to restrain the fuel evaporative emission from leaking to the atmosphere.

Even if a liquid fuel is introduced into the fuel tank 100, the valve 13 is not opened because it is pressed by the strong spring 15 when the engine is stopped, so that the liquid fuel is completely prevented from entering into the canister 200.

Figure 3:
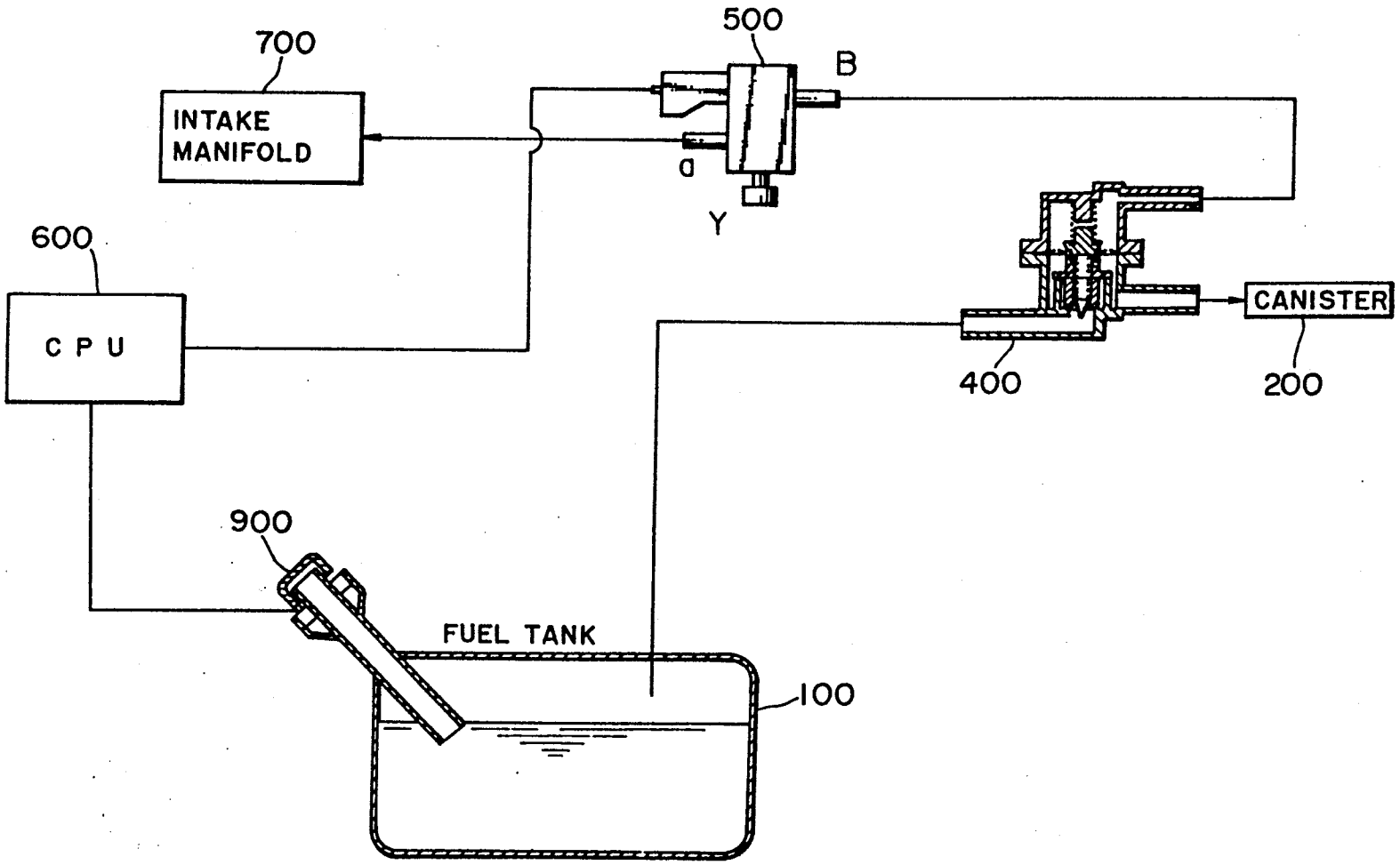
FIG. 3 is a view of assistance in explaining the fuel evaporative emission control system according to a second embodiment of the present invention.

Second Embodiment (FIG. 3):

A fuel evaporative emission control system according to the second embodiment will be described with reference to FIG. 3. The control system comprises the fuel tank 100, the fuel evaporative emission backflow valve 400 coupled to the fuel tank 100, the canister 200 coupled to the fuel evaporative emission backflow valve 400, a solenoid valve 500 coupled to the fuel evaporative emission backflow valve 400, the intake manifold 700 coupled to the solenoid valve 500 and a CPU (central processing unit) 600 disposed between the fuel tank 100 and the solenoid valve 500. The solenoid valve 500 has a first port $\alpha$ communicating with the intake manifold 700, a second port $\beta$ communicating with the fuel evaporative emission backflow valve 400 and a third port $\gamma$ communicating with the atmosphere.

An operation of the control system according to the second embodiment will be described hereinafter. The second embodiment intends to cope with the situation where the fuel is supplied into the fuel tank 100 while the engine runs.

While the engine runs, a negative pressure supplied from the intake manifold 700 permits both a first port $\alpha$ and a second port $\beta$ of the solenoid valve 500 to communicate with each other and closes the third port $\gamma$ when the solenoid valve 500 receives an instruction signal issued by the CPU 600. Accordingly, the diaphragm 8 of the fuel evaporative emission backflow valve 400 is pulled up and the valve 13 is pressed by the weak spring 14 so as to permit the communication from the tank 100 to the canister 200. As a result, when the fuel evaporative emission is generated in the fuel tank 100 to thereby change the pressure in the fuel tank 100, the valve 13 is responsive sharply to the change of the pressure and is opened so that the valve 13 operates always to escape the fuel evaporative emission. When the filler cap is opened during fuel supply while the engine runs, the CPU 600 issues an instruction signal to close the $\alpha$ port of the solenoid valve 500 and to permit the $\gamma$ port to communicate with the $\beta$ port so that the fuel evaporative emission backflow valve 400 communicating with the atmosphere. As a result, the diaphragm 8 is pulled down so that the valve 13 is pressed by the strong spring 15 so that the communication between the fuel tank side and the canister side is tightly closed while the engine runs, which prevents the liquid fuel from entering into the canister 200 during fuel supply.

Figure 4:
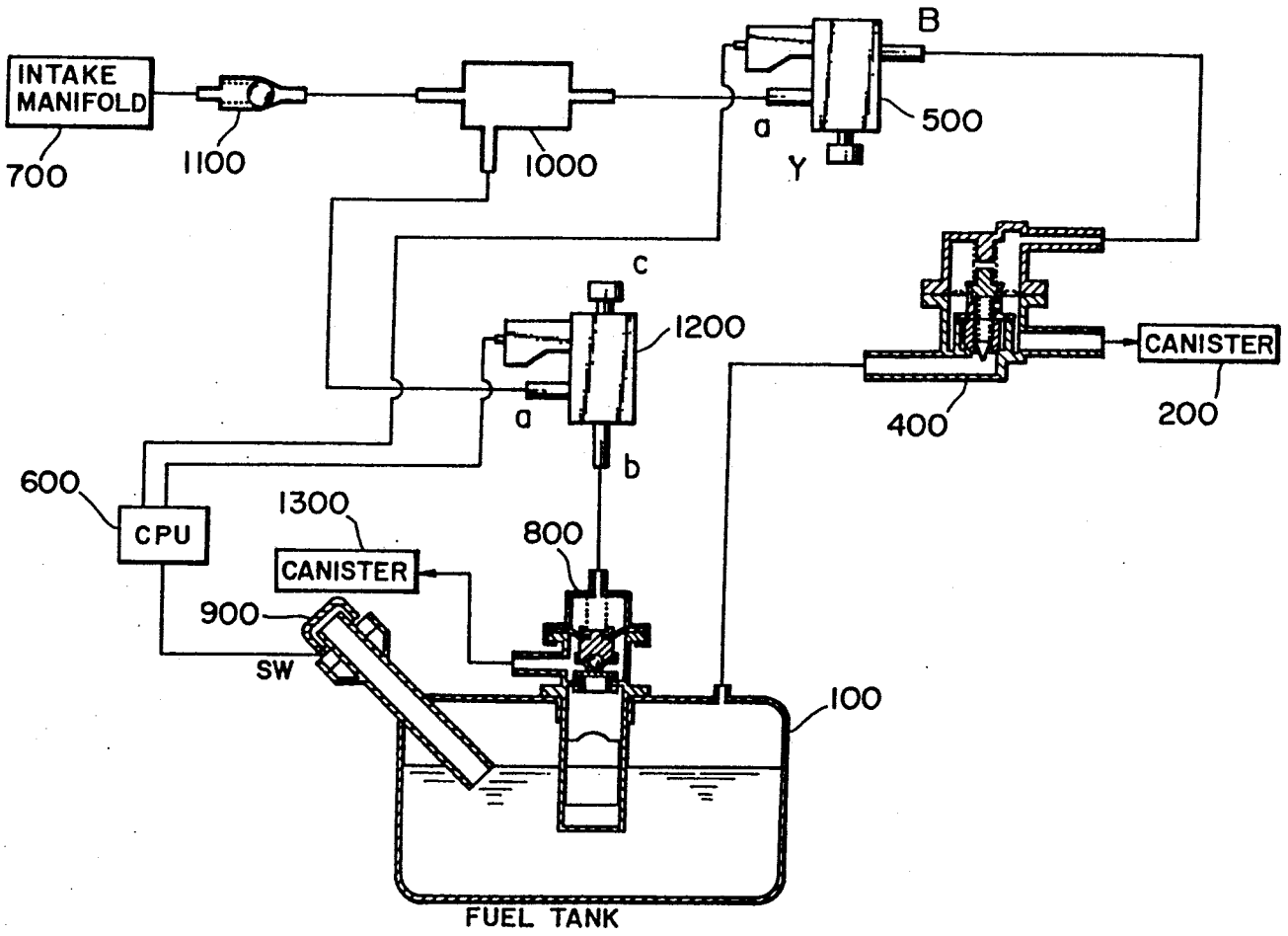
FIG. 4 is a view of assistance in explaining the fuel evaporative emission control system according to a third embodiment of the present invention.

Third Embodiment (FIG. 4):

A fuel evaporative emission control system according to a third embodiment, which is an improvement of the second embodiment, will be described with reference to FIG. 4.

The control system comprises the fuel tank 100, a first fuel evaporative emission backflow valve 400 coupled to the fuel tank 100, a first canister 200 coupled to the first fuel evaporative emission backflow valve 400, a first solenoid valve 500 coupled to the first fuel evaporating emission backflow valve 400, a vacuum tank 1000 coupled to the first solenoid valve 500, a check valve 1100 coupled to the vacuum tank 1000, the intake manifold 700 coupled to the check valve 1100, a second solenoid valve 1200 coupled to the vacuum tank 1000, the CPU 600 coupled to the first and second solenoid valves 500 and 1200. The fuel tank 100 has therein a second fuel evaporative emission backflow valve 800 and a filler cap 900. The second fuel evaporative emission backflow valve 800 is coupled to the second solenoid valve 1200 and a second canister 1300. The filler cap 900 is coupled to the CPU 1000. The first solenoid valve 500 has an $\alpha$ port communicating with the vacuum tank 1000, a $\beta$ port communicating with the fuel evaporative emission backflow valve 400 and a $\gamma$ port communicating with the atmosphere. The second solenoid valve 1200 has an a port communicating with the vacuum tank 1000, a b port communicating with the second fuel evaporative emission backflow valve 800 and a c port communicating with the atmosphere.

An operation of the control system according to the third embodiment will be described hereinafter.

When a negative pressure generated in the intake manifold 700 is accumulated in the vacuum tank 1000 irrespective of the engine is running or stopped, the negative pressure influences the first solenoid valve 500 so that the control system operates in the same manner as the second embodiment. At this time, the port a of the second solenoid valve 1200 is closed and the ports b and c thereof are opened upon reception of an instruction signal from the CPU 600 whereby the second solenoid valve 1200 is under the atmospheric pressure and the fuel evaporative emission backflow valve 800 is closed.

When the fuel is supplied into the fuel tank 100 while the filler cap is opened and the engine runs, the CPU 600 detects the opening of the filler cap 900 and issues an instruction signal to the first solenoid valve 500 to close the $\alpha$ port and open the $\beta$ and $\gamma$ ports of the same, which permits the first fuel evaporative emission backflow valve 400 to communicate with the atmosphere. Consequently, since the fuel evaporative emission backflow valve 400 is closed by the strong spring 15, the fuel evaporative emission and the liquid fuel in the fuel tank 100 are prevented from flowing into the fuel evaporative emission backflow valve 400.

At the same time, the CPU 600 issues an instruction signal to the second solenoid valve 1200 to thereby close the c port thereof and open the a and b ports thereof so that the second fuel evaporative emission backflow valve 800 receives the negative pressure generated in the vacuum tank 1000 via the second solenoid valve 1200. As a result, the second fuel evaporative emission backflow valve 800 is opened. Consequently, the fuel evaporative emission in the fuel tank 100 is not discharged from the fuel supply port of the filler cap 900 to the atmosphere but discharged from the second fuel evaporative emission backflow valve 800 to the second canister 1300 and absorbed by the second canister 1300 when the filler cap 900 is opened during fuel supply. The first fuel evaporative emission backflow valve 400 permits the fuel evaporative emission to be absorbed by the first canister 200 while the engine runs and the second fuel evaporative emission backflow valve 800 permits the fuel evaporative emission generated and residual in the fuel tank 100 to discharge during fuel supply. When the filler cap 900 is closed, the first fuel evaporative emission backflow valve 400 is opened and the second fuel evaporative emission backflow valve 800 is closed so that the fuel evaporative emission in the fuel tank 100 flows to the first canister 200 through the first fuel evaporative emission backflow 400. Whereupon, when the filler cap 900 is opened during fuel supply, the fuel evaporative emission backflow valve 400 is closed and the fuel evaporative emission backflow valve 800 is opened so that the fuel evaporative emission in the fuel tank 100 flows to the second canister 1300 through the fuel evaporative emission backflow valve 800. Accordingly, the fuel evaporative emission is not directly discharged from the filler cap 900 to the atmosphere.

Figure 5:
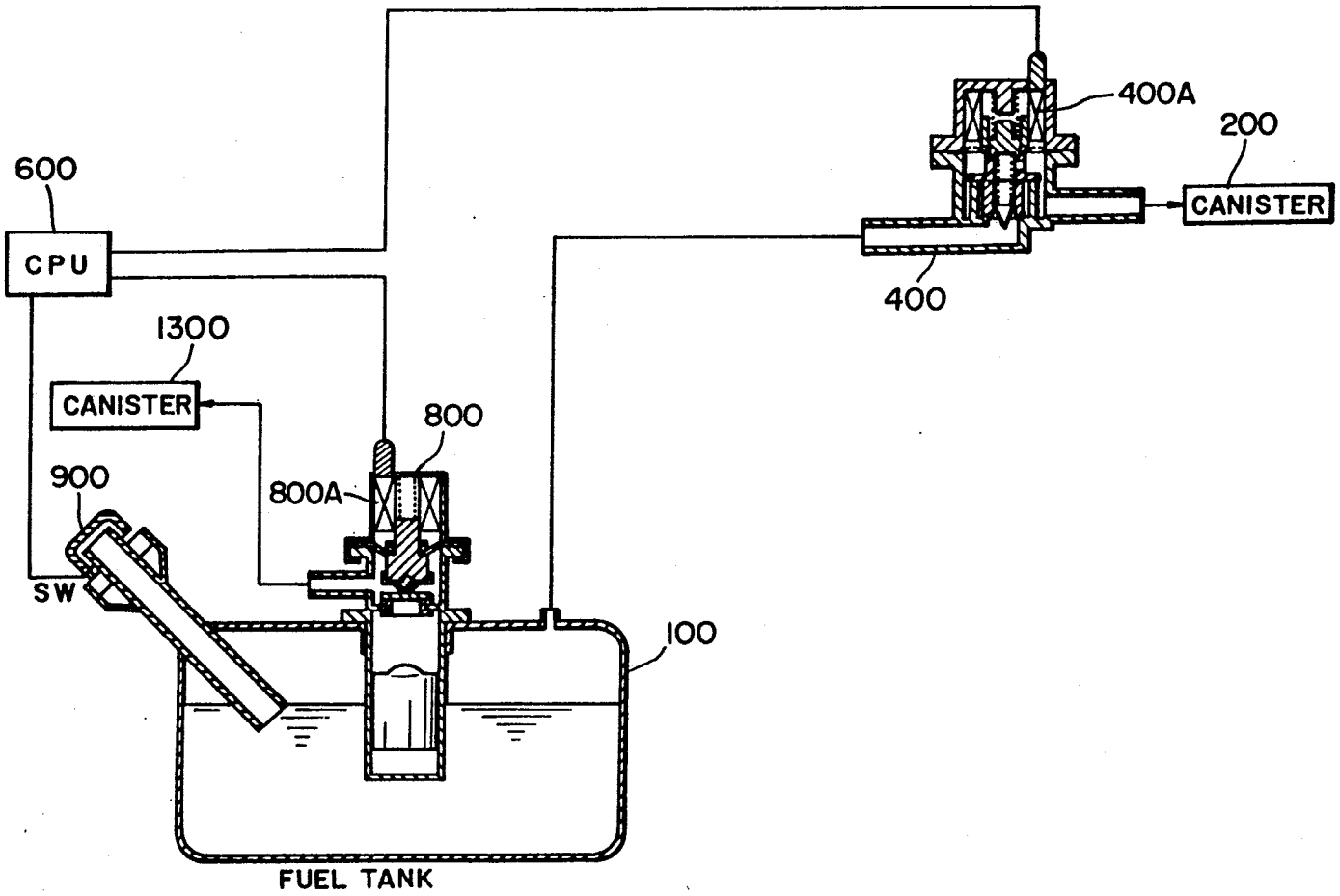
FIG. 5 is a view of assistance in explaining the fuel evaporative emission control system according to a fourth embodiment of the present invention.
Figure 6:
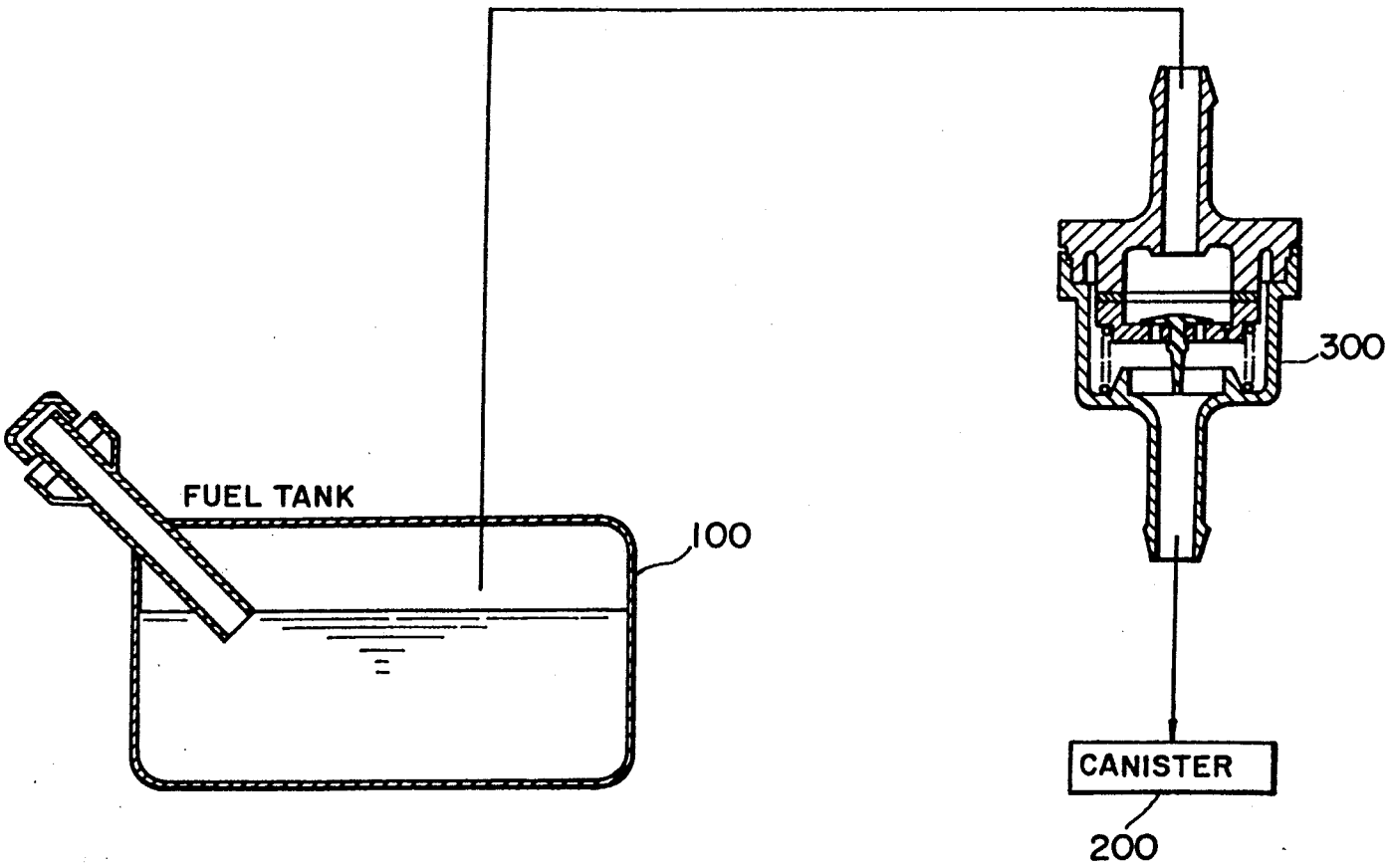
FIG. 6 PRIOR ART
FIG. 6 is a view of assistance in explaining a conventional fuel evaporative emission control system.
Figure 7:
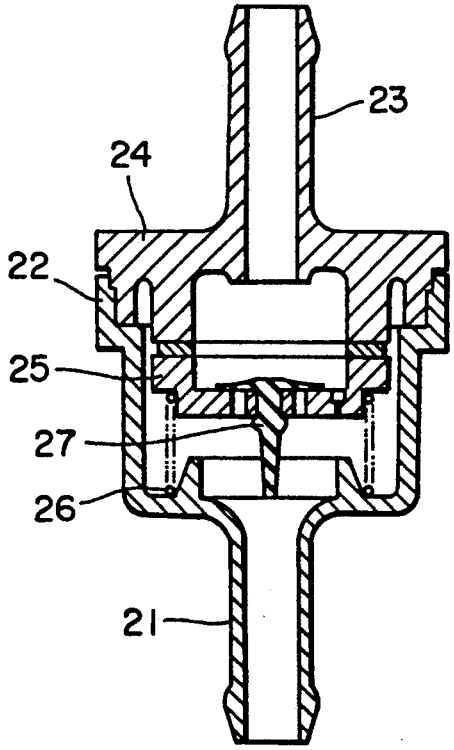
FIG. 7 PRIOR ART
FIG. 7 is a view of assistance in explaining a fuel evaporative emission backflow valve employed in a conventional fuel evaporative emission control system.

Fourth Embodiment (FIG. 5):

A fuel evaporation emission control system according to the fourth embodiment will be described with reference to FIG. 5. The fourth embodiment relates to a modification of the second and third embodiments wherein the control system in the fourth embodiment is performed by an electric control while the control system in the second and third embodiments is performed by a negative pressure generated in the intake manifold.

That is, when the CPU 600 receives signals representative of the opening and closing of the filler cap 900 from a switch (not shown), it energizes a coil 400A provided in an upper case of the first fuel evaporative emission backflow valve 400 to thereby close or open the same valve 400. Likewise, when the CPU 600 receives signals representative of the opening and closing of the filler cap 900 from the switch (not shown), it energizes a coil 800A provided in an upper case of the second fuel evaporative emission backflow valve 800 to thereby close or open the same valve 800. An operation of the control system according to the fourth embodiment is the same as that of the third embodiment.

With the arrangement of the present invention, there are following advantages.

Since the fuel evaporative emission, which is generated in the fuel tank due to a delicate reduction of the pressure in the fuel tank caused by the reduction of the fuel, etc., is always flowed back by the fuel evaporative emission backflow valve provided with the weak spring which is very sensitive to the change of pressure while the engine runs, it is possible to restrain the fuel evaporative emission in the fuel tank to the utmost.

Furthermore, the CPU detects the opening of the filler cap when the fuel is supplied into the fuel tank while the engine runs and controls the opening of the ports of the solenoid valve so that the negative pressure generated in the intake manifold is prevented from entering the fuel evaporative emission backflow valve. The fuel evaporative emission backflow valve has a strong spring which prevents the liquid fuel from flowing out from the fuel evaporative emission backflow valve.

What is claimed is:

1. In a fuel evaporative emission control system comprising a fuel tank, a canister for absorbing fuel evaporative emission generated in the fuel tank and a fuel evaporative emission backflow valve which is disposed on a pipe which extends between the fuel tank and the canister, an intake manifold coupled to the fuel evaporative emission backflow valve, characterized in that the fuel evaporative emission backflow valve includes a first valve which is opened by a negative pressure generated in the intake manifold when the engine runs, a second valve which is opened when a pressure in the fuel tank exceeds a given pressure while the engine runs and a third valve which permits communication from the canister to the fuel tank when the fuel tank is negatively pressurized.

2. A fuel evaporative emission control system according to claim 1 further comprising a switch for detecting opening of the filler cap during fuel supply and a solenoid valve for switching the negative pressure generated in the intake manifold to the atmosphere and vice versa.

3. A fuel evaporative emission control system according to claim 2 further comprising a vacuum tank for accumulating the negative pressure generated in the intake manifold and a valve for permitting the communication from the fuel tank to the canister during fuel supply.

4. A fuel evaporative emission control system comprising a fuel tank, a fuel evaporative emission backflow valve coupled to the fuel tank, a canister coupled to the fuel evaporative emission backflow valve, a solenoid valve coupled to the fuel evaporative emission backflow valve, an intake manifold coupled to the solenoid valve and a CPU (central processing unit) disposed between the fuel tank and the solenoid valve, wherein the solenoid valve has a first port communicating with the intake manifold, a second port communicating with the fuel evaporative emission backflow valve and a third port communicating with the atmosphere.

5. A fuel evaporative emission control system comprising a fuel tank, a first fuel evaporative emission backflow valve coupled to the fuel tank, a first canister coupled to the first fuel evaporative emission backflow valve, a first solenoid valve coupled to the first fuel evaporative emission backflow valve, a vacuum tank coupled to the first solenoid valve, a check valve coupled to the vacuum tank, an intake manifold coupled to the check valve, a second solenoid valve coupled to the vacuum tank, a CPU coupled to the first and second solenoid valves, the fuel tank has therein a second fuel evaporative emission backflow valve and a filler cap, wherein the second fuel evaporative emission backflow valve is coupled to the second solenoid valve and a second canister, wherein the filler cap is coupled to the CPU, and wherein the first solenoid valve has a first port communicating with the vacuum tank, a second port communicating with the first fuel evaporative emission backflow valve and a third port communicating with the atmosphere.

* * * * *

UNITED STATES PATENT AND TRADEMARK OFFICE

CERTIFICATE OF CORRECTION

PATENT NO. : 5 235 955

DATED : August 17, 1993

INVENTOR(S) : Hiroshi Osaki

It is certified that error appears in the above-identified patent and that said Letters Patent is hereby corrected as shown below:

On the title page of the patent, insert the following priority information:

---[30] Foreign Application Priority Data

June 21, 1991 [JP] Japan.....3-247167---.

Signed and Sealed this

Fifteenth Day of March, 1994

*Attest:*

Bruce Lehman

BRUCE LEHMAN

*Attesting Officer*

*Commissioner of Patents and Trademarks*